US007699946B2

(12) United States Patent
Zhao et al.

(10) Patent No.: US 7,699,946 B2
(45) Date of Patent: Apr. 20, 2010

(54) PREPARATION OF NANOSTRUCTURED MATERIALS HAVING IMPROVED DUCTILITY

(75) Inventors: Yonghao Zhao, Los Alamos, NM (US); Yuntian T. Zhu, Los Alamos, NM (US)

(73) Assignee: Los Alamos National Security, LLC, Los Alamos, NM (US)

( * ) Notice: Subject to any disclaimer, the term of this patent is extended or adjusted under 35 U.S.C. 154(b) by 686 days.

(21) Appl. No.: 11/438,929

(22) Filed: May 22, 2006

(65) Prior Publication Data

US 2008/0196801 A1 Aug. 21, 2008

Related U.S. Application Data

(60) Provisional application No. 60/714,794, filed on Sep. 7, 2005.

(51) Int. Cl.
*C21D 6/04* (2006.01)
*C21D 1/04* (2006.01)

(52) U.S. Cl. ..... 148/577; 148/695; 148/697

(58) Field of Classification Search ..... 148/577, 148/578, 695, 697
See application file for complete search history.

(56) References Cited

U.S. PATENT DOCUMENTS 4,643,779 A * 2/1987 Abbaschian et al. ..... 148/577
2002/0007880 A1* 1/2002 Segal et al. ..... 148/438
2004/0060620 A1 4/2004 Ma et al.

OTHER PUBLICATIONS

Wang et al., "High Tensile Ductility in a Nanostructured Metal", Nature, vol. 419, No. 31, Oct. 2002, pp. 912-915.
Valiev et al., "Paradox of Strength and Ductility in Metals Processed by Severe Plastic Deformation", J. Mater. Res., vol. 17, No. 1, Jan. 2002, pp. 5-8.
Youssef et al., "Ultratough Nanocrystalline Copper with a Narrow Grain Size Distribution", Appl Phys. Lett., vol. 85, No. 6, Aug. 2004, pp. 929-931.
Wang et al., "Tough Nanostructured Metals at Cryogenic Temperatures", Adv. Mater., vol. 16, No. 4, Feb. 2004, pp. 328-331.
Horita et al., "Achieving High Strength and High Ductility in Precipitation-Hardened Alloys", Adv. Mater., vol. 17, pp. 1599-1602.
Zhao et al., "Structure Characteristics of Nanocrystalline Element Selenium With Different Grain Sizes" Phys. Rev. B, vol. 56, No. 22, Dec. 1997-II, pp. 14322-14329.
Jia et al., "Deformation Behavior and Plastic Instabilities of Ultrafine-Grained Titanium", Appl. Phys. Lett., vol. 79, No. 5, Jul. 2001, pp. 611-613.
Valiev, "Nanostructuring of Metals by Severe Plastic Deformation for Advanced Properties", Nature Materials, vol. 3, Aug. 2004, pp. 511-516.

(Continued)

*Primary Examiner*—Roy King
*Assistant Examiner*—Janelle Morillo
(74) *Attorney, Agent, or Firm*—Samuel L. Borkwosky

(57) ABSTRACT

A method for preparing a nanostructured aluminum alloy involves heating an aluminum alloy workpiece at temperature sufficient to produce a single phase coarse grained aluminum alloy, then refining the grain size of the workpiece at a temperature at or below room temperature, and then aging the workpiece to precipitate second phase particles in the nanosized grains of the workpiece that increase the ductility without decreasing the strength of the workpiece.

9 Claims, 5 Drawing Sheets

OTHER PUBLICATIONS

Hart, "Theory of the Tensile Test", Acta Metallurgica, vol. 15, Feb. 1967, pp. 351-355.

Wang et al., "Temperature and Strain Rate Effects on the Strength And Ductility of Nanostructured Copper", Appl. Phys. Lett., vol. 83, No. 15, Oct. 2003, pp. 3165-3167.

Koch, "Optimization of Strength and Ductility in Nanocrystalline and Ultrafine Grained Metals", Scripta Materialia, vol. 49, Oct. 2003, pp. 657-662.

Toman, "The Structure of Guinier-Preston Zones. I. The Fourier Transform of the Diffuse Intensity Diffracted by a Guinier-Preston Zone", Acta Cryst., vol. 8, Mar. 1955, pp. 587-591.

Zhao et al., "Microstructures and Mechanical Properites of Ultrafine Grained 7075 Al Alloy Processed by ECAP and Their Evolutions During Annealing", Acta Materialia, vol. 52, Jun. 2004, pp. 4589-4599.

Taylor, "The Mechanism of Plastic Deformation of Crystals. Part I. Theoretical", Royal Society of London, Series A, vol. 145, No. 855, Jul. 1934, pp. 362-387.

Lu et al., "Ultrahigh Strength and High Electrical Conductivity in Copper," Science, vol. 304, Apr. 2004, pp. 422-426.

Ma et al., "Strain Hardening and Large Tensile Elongation in Ultrahigh-Strength Nano-Twinned Copper," Appl. Phys. Lett., vol. 85, No. 21, Nov. 2004, pp. 4932-4934.

Li et al., "Transition of Deformation and Fracture Behaviors in Nanostructured Face-Centered-Cubic Metals", Appl. Phys. Lett., vol. 84, No. 21, May 2004, pp. 4307-4309.

Suryanarayanan et al., "Mechanical Properties of Nanocrystalline Copper Produced by Solution-Phase Synthesis", J. Mater. Res., vol. 11; No. 2, Feb. 1996, pp. 439-448.

Kelly et al., "Precipitation Hardening", Science, vol. 10, pp. 151-391.

"Understanding Cold Finished Aluminum Alloys", Product Data Sheet for Aluminum Alloy 7075, available online from ALCOA (The Aluminum Company of America) www.alcoa.com/gcfp.

* cited by examiner

PREPARATION OF NANOSTRUCTURED MATERIALS HAVING IMPROVED DUCTILITY

RELATED APPLICATIONS

This application claims the benefit of U.S. Provisional Patent Application Ser. No. 60/714,794, filed Sep. 7, 2005, hereby incorporated by reference.

STATEMENT REGARDING FEDERAL RIGHTS

This invention was made with government support under Contract No. W-7405-ENG-36 awarded by the U.S. Department of Energy. The government has certain rights in the invention.

FIELD OF THE INVENTION

The present invention relates generally to nanostructured materials and more particularly to the preparation of nanostructured materials having improved ductility.

BACKGROUND OF THE INVENTION

Nanostructured (NS) materials formed by severe plastic deformation techniques such as rolling, drawing, and extrusion are much stronger than their coarse-grained (CG) counterparts. However, applications for these types of nanostructured materials are limited because these techniques, which reduce the grain size and increase the strength, also reduce the ductility. As a result, these types of nanostructured materials possess very low (nearly zero) uniform tensile elongation, which results in necking immediately after yielding in tension. The onset of localized deformation in tension is governed by the equation $$\left(\frac{\partial\sigma}{\partial\varepsilon}\right)_{\varepsilon} \leq \sigma \tag{1}$$

where $\sigma$ is the true stress, and $\epsilon$ is the true strain. The loss of strain hardening during severe plastic deformation results from the reduction of the dislocation storage capacity in the tiny grains of the materials. The loss of dislocation storage capacity in these high strength materials makes them prone to plastic instability (early necking), which leads to lower uniform elongation.

Recent efforts have been made in improving the ductility of nanostructured materials by increasing the dislocation storage capacity of the grains to regain the strain hardening that is lost due to small grain sizes. The strategies employed in regaining the strain hardening generally involve tailoring the microstructures of the materials and changing the tensile conditions. Y. Wang et al. in "High Tensile Ductility in a Nanostructured Metal," Nature, vol. 419, October 2002, pp. 912-916, for example, describe a method for improving strain hardening in copper by rolling copper at liquid nitrogen temperature to suppress dynamic recovery and allow the density of accumulated dislocations to reach a higher steady state level than what can be achieved at room temperature. Afterward, the material is annealed at a temperature of 180 degrees Celsius. The result is a material having a bimodal grain size distribution of micrometer size grains embedded in a matrix of nanocrystalline and ultrafine grains. The matrix grains impart high strength while the inhomogeneous microstructure induces strain hardening in the material. This method has also been described in U.S. Published Patent Application Number 2004/0060620 to Ma et al. entitled "High Performance Nanostructured Materials and Methods of Making the Same".

Valiev et al. in "Paradox of Strength and Ductility in Metals Processed by Severe Plastic Deformation," Journal of Materials Research, vol. 17, no. 1, January 2002, pp. 5-8, describe that treatment of copper by cold rolling to a thickness reduction of 60 percent significantly increased the strength but dramatically decreased the elongation to failure (which is a quantitative measure of ductility). Valiev et al. report that treatment of copper to two passes through an equal channel angular pressing (ECAP) die also increased the strength of the copper but decreased the ductility. However, continued deformation of the copper for a total of sixteen passes through the ECAP die increased both the strength and the ductility, and the increase in ductility was even greater than the increase in strength. Similar results were observed by subjecting titanium to high-pressure torsion. Transmission electron micrographs of the resulting ultrafine-grained materials show that the mean grain size for these materials is about 100 nm for copper and for titanium.

Youssef et al. in "Ultratough Nanocrystalline Copper With a Narrow Grain Size Distribution," Applied Physics Letters, vol. 85, no. 6, 9 Aug. 2004, pp. 929-931, describe a method of preparing high strength copper with good ductility. The method involves milling copper powder at liquid nitrogen temperature, then flattening the milled powder, and then welding the powder to form thin flakes. Continued milling at room temperature and at cryogenic temperatures induced in situ consolidation of the flakes into fully dense nanocrystalline copper spheres having high yield strength (770 MPa) and good ductility.

Wang et al. in "Tough Nanostructured Metals at Cryogenic Temperatures," Advanced Materials, vol. 16, no. 4, 17 Feb. 2004, pp. 328-331, describe a method for preparing nanostructured metals by equal channel angular pressing followed by cold rolling. The study found that strength and ductility can be improved at low temperatures and high strain rates. However, the method does not work at room temperature and quasi-static service conditions.

Horita et al. in "Achieving High Strength and High Ductility in Precipitation-Hardened Alloys," Advanced Materials, vol. 17 (2005) pp. 1599-1602, describe processing an Al-10.8 wt % Ag by first heating the alloy to dissolve second phase particles, then refining the grain size by equal channel angular pressing (ECAP), and then annealing. This process rendered the alloy with both high strength and good ductility.

The strategies used in the above methods attempt to regain the strain hardening of nanostructured materials and improve the ductility by increasing the dislocation storage capacity of the materials. However, improvements in the ductility are always accompanied by a decrease in the strength.

There remains a need for nanostructured materials having improved ductility, but not at the expense of strength.

SUMMARY OF THE INVENTION

In accordance with the purposes of the present invention, as embodied and broadly described herein, the present invention includes a method for preparing a nanostructured aluminum alloy comprising heating an aluminum alloy workpiece at a temperature sufficient to produce a single phase of coarse grained aluminum alloy; refining the grain size of the workpiece at a temperature of room temperature or below until the average grain size is less than 1000 nanometers and the strength of the workpiece increases; and aging the workpiece to induce the formation of second phase particles in the nanosized grains that increase the ductility without decreasing the strength of the workpiece.

The invention also includes a method for preparing a metal alloy comprising refining the grain size of a coarse grained single phase metal alloy until the grains of the coarse grained metal alloy are refined to an average grain size of less than 1000 nanometers, the deformed metal alloy comprising a first strength S1 and a first ductility D1; and thereafter aging the metal alloy at a temperature sufficient to induce the formation of second phase particles in the grains of the alloy, the annealed alloy comprising a second strength S2 and a second ductility D2, wherein S2≧S1, and wherein D2>D1.

The invention also includes a method for increasing the ductility of a workpiece comprising introducing small second phase particles into grains of a workpiece comprising an average grain size≦1000 nm, whereby the ductility of the workpiece is increased without decreasing the strength of the workpiece.

BRIEF DESCRIPTION OF THE DRAWINGS

The accompanying drawings, which are incorporated in and form a part of the specification, illustrate the embodiment(s) of the present invention and, together with the description, serve to explain the principles of the invention. In the drawings.

DETAILED DESCRIPTION

Figure 1A:
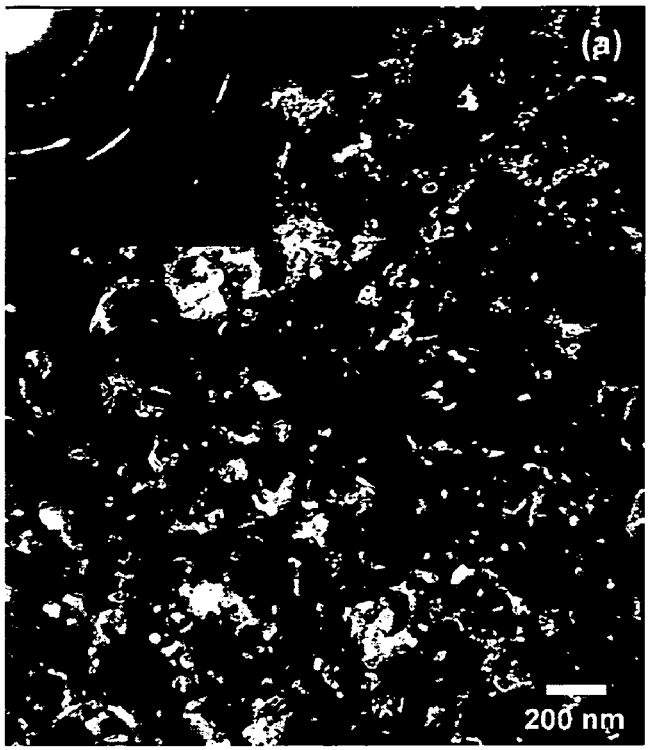
FIG. 1*a* shows a dark-field transmission electron micrograph image of a sample of nanostructured 7075 aluminum after cold rolling.

The invention is concerned with preparing nanostructured materials having improved ductility. The invention was demonstrated using a 7000 series aluminum alloy known in the art as aluminum 7075. Samples of 7075 aluminum alloy were heat treated to form single-phase coarse-grained aluminum 7075 alloy, which was subsequently rolled at a cryogenic temperature and then subjected to aging at an elevated temperature. The result of the rolling was nanostructured 7075 alloy with much higher strength than the coarse-grained 7075 alloy but with low ductility, and the result of aging was an improvement in both the strength and ductility of the nanostructured alloy. Transmission electron micrograph (TEM) images and x-ray diffraction spectra demonstrate that the aging resulted in the formation of second phase particles in a nanostructured matrix. While not wishing to be bound by the present explanation, the formation of the second phase particles is believed to contribute to the observed enhancement in the ductility of the nanostructured alloy sample as measured by an improvement in the uniform tensile elongation.

Also while not wishing to be bound by the present explanation, it is believed that the measured improvement in ductility is largely a result of an increase in the strain hardening and dislocation storage capacity of the alloy sample. This increase in strength and ductility is due to the resistance to the movement of dislocations as well as the accumulation of dislocations in the matrix of the nanostructured alloy provided by the second phase particles that form upon aging of the cold rolled alloy sample.

A sample of coarse grained (CG) 7075 aluminum alloy was prepared by heating a sample of 7075 aluminum alloy at a temperature of about 500 degrees Celsius for about 5 hours. The effect of heating the aluminum alloy under these conditions was to dissolve all second phase particles to form a single solid phase composed of aluminum and alloy elements. The alloy sample was then quenched in liquid nitrogen. TEM images of the quenched sample show that the average grain size, d, of the sample is about 8 μm, and the orientation between neighboring grains is high-angle. While quenching was performed by cryogenic cooling using liquid nitrogen was used for this example and is preferred, it should be understood that quenching may also include other types of cooling (ice bath, dry ice/ethanol, dry ice/acetone, liquid nitrogen/solvent, and the like).

After quenching, the sample was immediately rolled to an 80 percent reduction in thickness. The rolling procedure required several passes, and was accomplished by immersing the sample in liquid nitrogen between consecutive rolling passes. The sample temperature before and after each rolling pass is estimated to be in the range of from about −150 degrees Celsius to about −100 degrees Celsius. It should be understood that while immersing the sample in liquid nitrogen between consecutive passes is preferred, the sample may be cooled using other cold liquids (ice bath, dry ice/ethanol, dry ice/acetone, liquid nitrogen/solvent, and the like) or gases. In between rolling passes, the sample temperature should be a temperature at or below room temperature.

Figure 1B:
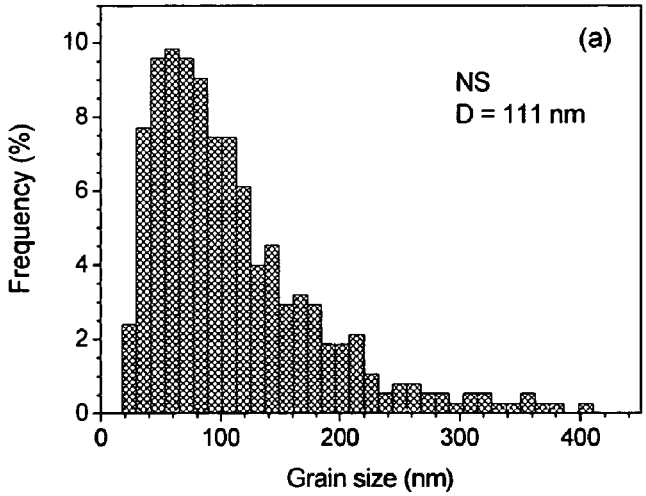
FIG. 1*b* shows the grain size distribution of the nanostructured sample. The inset is the selected area diffraction pattern (SAD) from a circular area with a diameter of 1 μm.
Figure 2:
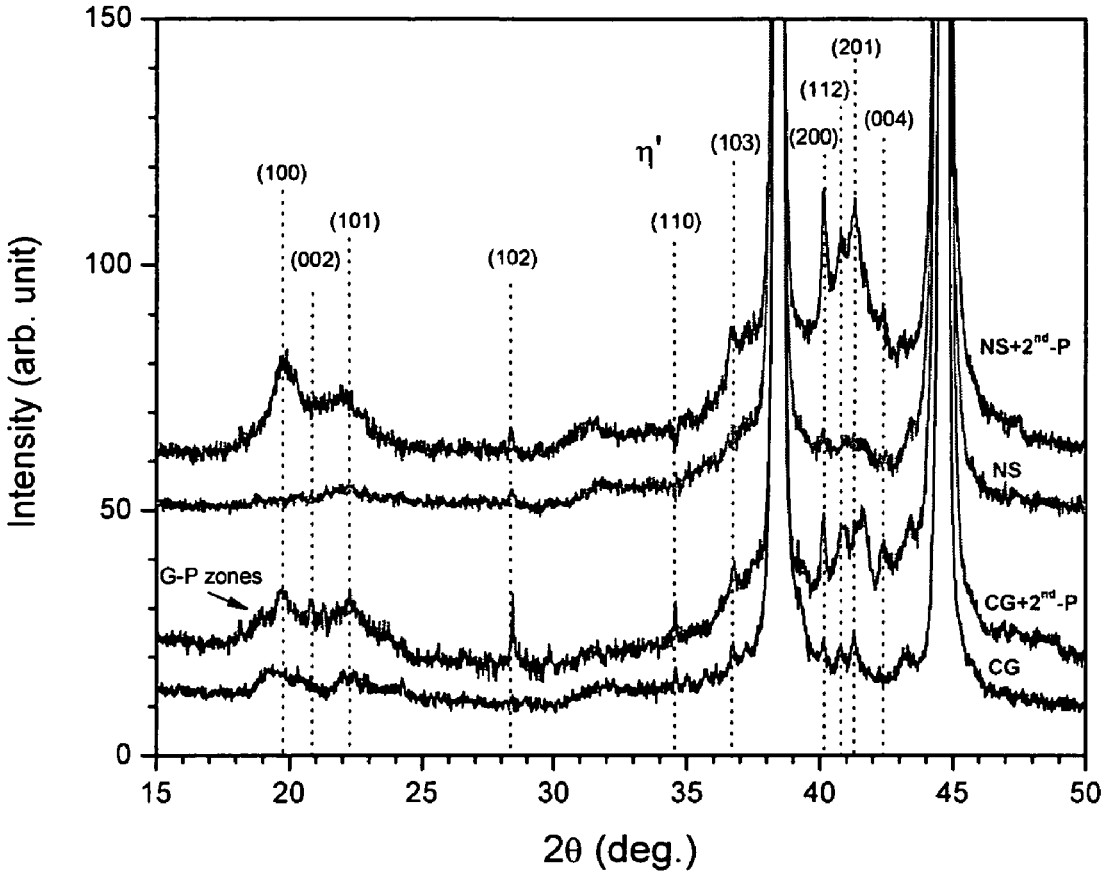
FIG. 2 shows XRD spectra for (a) a sample of coarse grained (CG) aluminum alloy (bottom spectrum); (b) a sample of CG aluminum alloy after annealing (second spectrum from bottom); (c) a sample of CG aluminum alloy after rolling (second spectrum from top); and (d) a sample of CG aluminum alloy after rolling and aging (top spectrum).

FIG. 1*a* shows a dark-field TEM image of the sample after the cold rolling procedure. FIG. 1*b* shows the grain size distribution of the sample. The inset is the selected area diffraction pattern (SAD) from a circular area with a diameter of 1 μm. As FIG. 1*a-b* show, the cold-rolling procedure resulted in refinement of the coarse grains into nanosized grains with an average grain size of about 110 nm and low-angle grain boundaries (GBs).

The XRD spectrum of the coarse grained sample indicates that the sample is texture free with a lattice parameter (a=4.0599 Å) larger than that for pure aluminum (a=4.0494 Å). The microstrain ($<\epsilon^2>^{1/2}$) of the sample, calculated from the XRD peak broadening (see: Zhao et al., Phys. Rev. B, vol.

56 (1997) pp. 14332-14329 (1997)), is about 0.069%. The dislocation density, ρ, is calculated from $<\epsilon^2>^{1/2}$ and d according to the formula $$\rho = \frac{2\sqrt{3} < \varepsilon^2 >^{1/2}}{db}$$

where b is the absolute value of Burgers vector.

The conclusion from the data is that the cold rolling procedure induced a texture in the alloy sample with (220) orientation, and increased $<\epsilon^2>^{1/2}$ and ρ, but did not change the lattice parameter (See TABLE 1).

The cold rolled sample was subjected to an aging procedure, which involved heating the sample at temperature of about 50 degrees Celsius for about 5 hours, and then at a temperature of about 120 degrees Celsius for about 10 hours, then at a temperature of about 80 Celsius for about 9 hours.

Figure 3A:
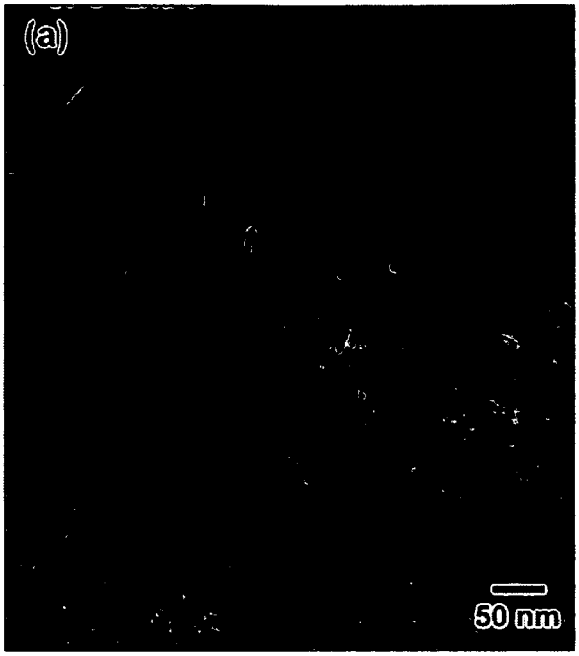
FIG. 3*a* shows a bright field transmission electron microscope (TEM) image of a sample of aluminum 7075 alloy after processing according to the invention.
Figure 4:
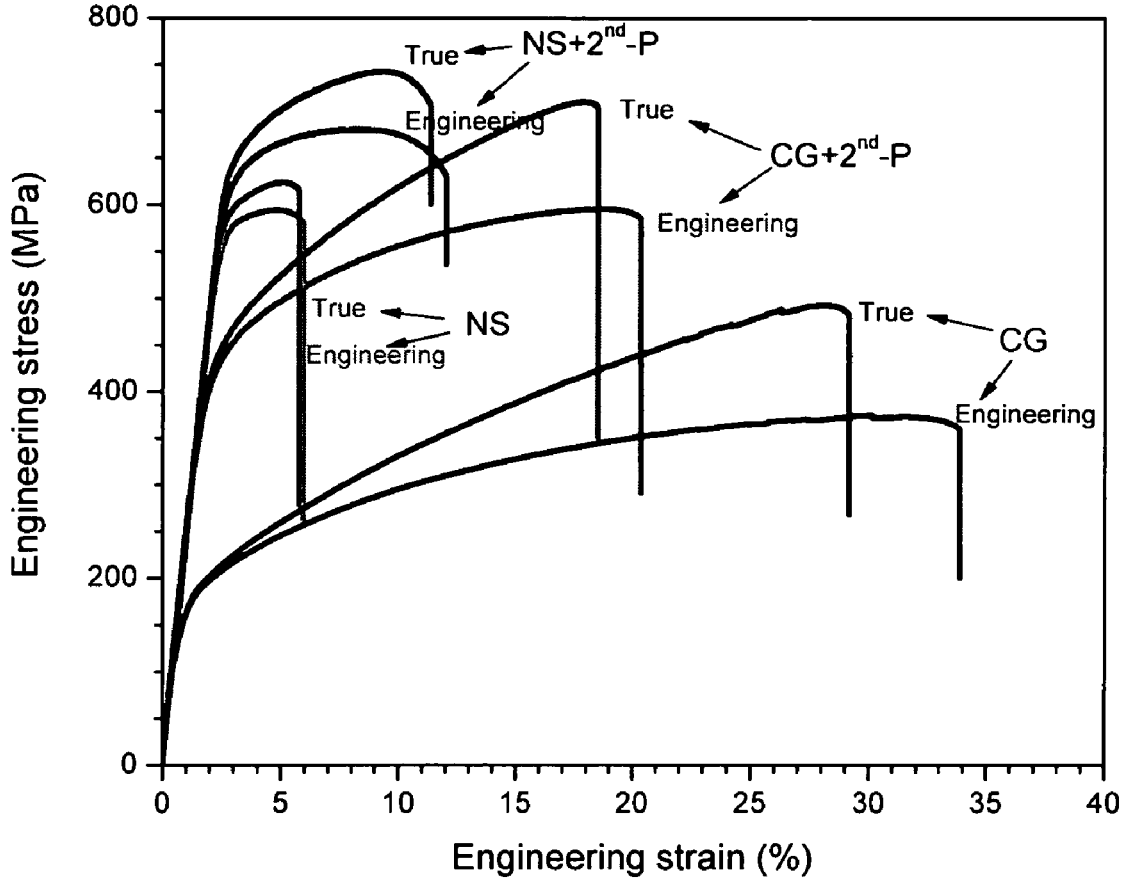
FIG. 4 shows tensile engineering and true stress-strain curves for the CG aluminum alloy sample, the CG sample after rolling, a CG sample after aging, and a nanostructured (NS) sample produced from a CG sample after rolling and aging.

FIG. 3*a* shows a bright field transmission electron microscope (TEM) image of the cold rolled sample after aging, and FIG. 4*b* shows a bright field image of the coarse grained sample after aging.

Figure 3B:
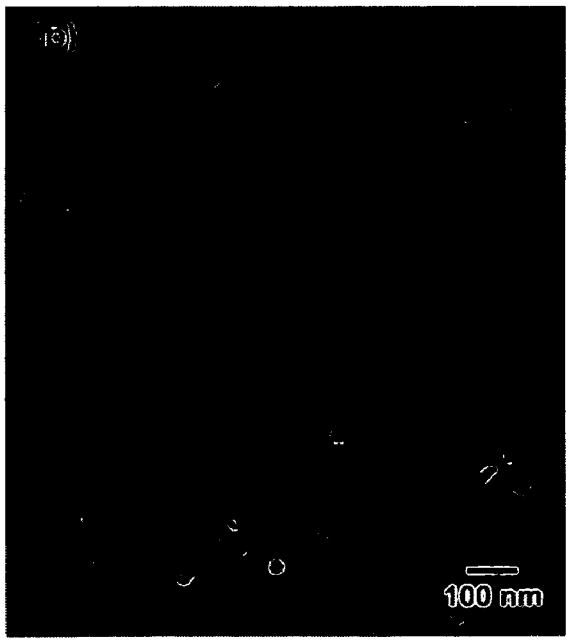
FIG. 3*b* shows a bright field image of a coarse-grained sample. Each sample includes G-P zones (second phase particles having a particle size of less than about 10 nm) and meta-stable η' phase (second phase particles having a particle size greater than about 10 nm)

As FIG. 3*a-b* show, after aging, that both the coarse grained sample and the nanostructured (cold rolled) sample include G-P zones (cluster of alloy elements having a diameter of less than about 10 nm) and meta-stable η' phases (second phase particles having a diameter of greater than about 10 nm) (see, for example: Jia et al., "Deformation Behavior and Plastic Instabilities of Ultrafine-Grained Titanium," App. Phys. Lett., vol. 79, no. 5, July 2001, pp. 611-613). As a result of the aging process, a large amount of G-P zones and meta-stable η' were formed in both the coarse grained sample and in the cold rolled sample, as shown in FIG. 3. A larger number of second phase particles formed in the nanostructured sample after aging compared to the coarse grained sample after aging, and the particle sizes of the cold rolled sample were smaller than those of the coarse grained sample. Accompanied with the formation of second phase particles, the lattice parameters for the aluminum matrix for the coarse grained sample and the nanostructured sample were reduced from 4.0599 to 4.0563 and 4.0569 Å, respectively.

Figure 6:
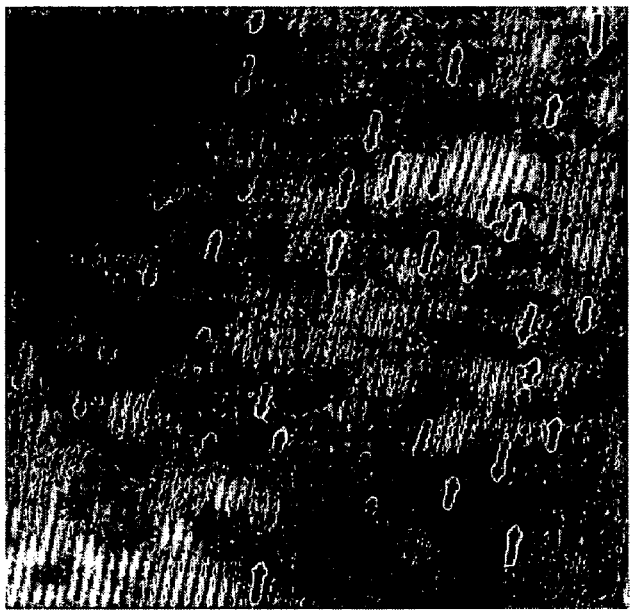
FIG. 6 shows a one-dimensional image obtained by Fourier and inverse Fourier transformations of an original high resolution TEM image. The end of each half atomic plane, which is the core position of a dislocation line, is marked with white arrows.

Room-temperature tensile tests were performed using a Shimadzu Universal Tester. Each sample was cut and polished into a bone-shaped specimen with a gauge length of 10.0 mm and a cross-section of 2.0×1.0 mm for tensile tests at a strain rate of $1.7\times10^{-4}$ $s^{-1}$. A long gauge length of 10.0 mm was used, because it was found that the ductility (especially the post-necking part) of nanostructured materials depends significantly on the specimen size (gauge length), where a longer gauge length results in a shorter but more credible ductility. For each sample, five specimens were used to get repeatable tensile curves. The tensile engineering and true stress-strain curves are shown in FIG. 6. For the coarse grained aluminum alloy samples, the aging increased the yield stress, $\sigma_y$, from 145 to 385 MPa, and the ultimate tensile stress, $\sigma_{UTS}$, from 374 to 596 MPa, respectively, but decreased the ductility ($\epsilon_E$, elongation to failure) from 33.8 to 20.4%. For the nanostructured aluminum alloy samples, the age-produced second phase particles not only increased the strength of each sample but also enhanced the ductility. The $\sigma_y$, $\sigma_{UTS}$ and $\epsilon_E$ of the un-aged NS 7075 Al sample are 550 MPa, 594 MPa and 5.9%, respectively. After low-temperature aging, these values are increased to 615 MPa, 680 MPa and 12.0%, respectively, as summarized in TABLE 1 below. The uniform tensile elongation of the aged NS+$2^{nd}$-P sample is about 7.0%, while the un-aged NS sample was only about 3.1%.

The average grain size (d), texture, lattice parameter (a), microstrain ($<\epsilon^2>^{1/2}$), type of grain-boundaries (GBs), and dislocation density (ρ) are summarized below in TABLE 1. Also included in TABLE 1 are tensile mechanical properties including yield strength ($\sigma_Y$), ultimate tensile strength ($\sigma_{UTS}$), elongation to failure ($\epsilon_E$), uniform tensile elongation ($\epsilon_U$) and work hardening exponent (n) of the quenched CG 7075 Al (written as CG), cold-rolled NS 7075 Al (NS), aged CG sample (CG+aging) and aged NS sample (CG+rolling+aging) before and after tension, which are described later.

TABLE 1

| | | Coarse grained sample after quenching (CG) | Coarse grained sample after aging (CG + aging) | Nanostructured sample formed from by rolling coarse grained sample (CG + rolling) | Nanostructured sample formed by rolling and aging coarse grained sample (CG + rolling + aging) |
|---|---|---|---|---|---|
| Relative number of second phase particles | | Few | Many | Few | Many |
| Structure of the aluminum matrix before tension | Grain boundaries | High-angle | High-angle | Low-angle | Low-angle |
| | d (nm) | 8150 | 8160 | 111 | 108 |
| | Texture | Free | Free | (220) | (220) |
| | a (Å) | 4.0599 | 4.0563 | 4.0599 | 4.0569 |
| | $<\epsilon^2>^{1/2}$ (%) | 0.069 | 0.069 | 0.362 | 0.309 |
| | $\rho(10^{13}\ m^{-2})$ | 0.10 | 0.10 | 39.53 | 34.50 |
| Structure of the aluminum matrix after tension | d (nm) | 8150 | 8160 | 110 | 101 |
| | $<\epsilon^2>^{1/2}$ (%) | 0.354 | 0.303 | 0.394 | 0.445 |
| | $\rho(10^{13}\ m^{-2})$ | 0.533 | 0.448 | 43.23 | 53.74 |
| Tensile mechanical properties | $\sigma_Y$(MPa) | 145 | 385 | 550 | 615 |
| | $\sigma_{UTS}$(MPa) | 374 | 596 | 594 | 680 |
| | $\epsilon_E$(%) | 33.8 | 20.4 | 5.9 | 12.0 |
| | $\epsilon_U$(%) | 27.1 | 16.3 | 3.1 | 7.0 |
| | n | 0.35 | 0.24 | 0.11 | 0.15 |

Based on the true stress-strain curves, the normalized work hardening rate, Θ, can be calculated using the equation $$\Theta = \frac{1}{\sigma}\left(\frac{\partial \sigma}{\partial \varepsilon}\right)_{\varepsilon}.$$

Figure 5:
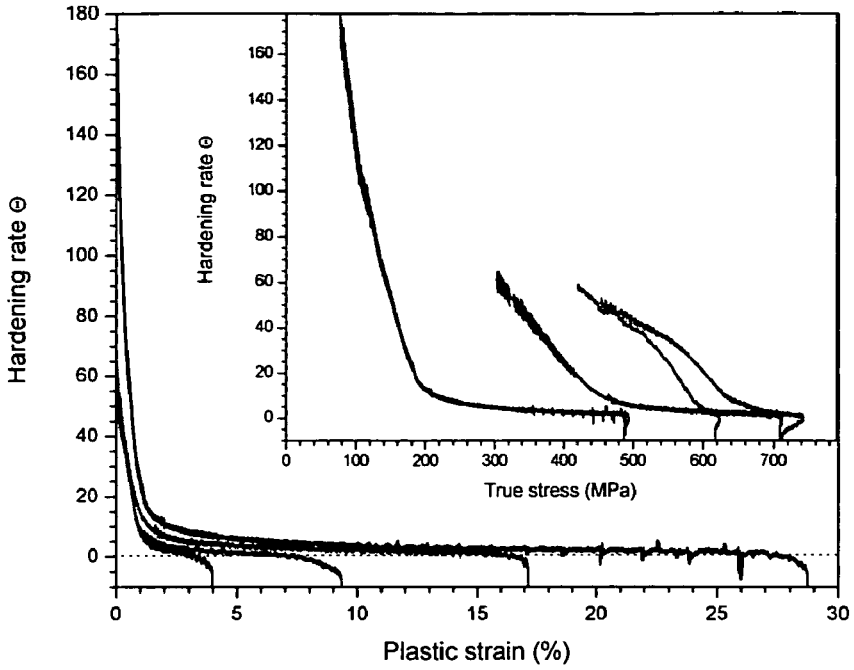
FIG. 5 shows graphical representations of normalized work hardening rates versus the plastic strain (a), and the true stress (b).

FIG. 5 shows Θ versus the plastic strain, $\epsilon_P$, and true stress σ. When $\epsilon_P$>1%, at a certain $\epsilon_P$ value, the quenched coarse-grained aluminum sample had the largest Θ value, and the aged coarse-grained sample with second phase particles had the next largest Θ. The cold-rolled sample has the smallest value of Θ and the aged cold rolled sample with second phase particles had the second smallest value for Θ. The Θ variation sequence is: $\Theta_{CG}>\Theta_{CG+2nd\text{-}P}>\Theta_{NS+2nd\text{-}P}>\Theta_{NS}$. In other words, the second phase particles in the nanostructured (cold rolled) 7075 Al alloy enhanced the strain hardening rate.

From the above analysis, the enhanced ductility of the aged nanostructured aluminum alloy (cold rolling+aging) sample is due to strain hardening. To find the origin of the enhance strain hardening in the aged nanostructured Al sample, XRD and TEM experiments were carried out on the tensile-tested samples. X-ray analysis indicated that in the Al sample processed by cold rolling+aging, the dislocation density increased from $34.5\times10^{13}$ $m^{-2}$ before the testing to $53.74\times10^{13}$ $m^{-2}$ after the tensile testing, suggesting that the strain hardening is from accumulation of dislocations.

The X-ray analysis was also confirmed using TEM images. FIG. 6 shows the high-resolution TEM images and its Fourier and inverse Fourier transformation for the aluminum alloy sample produced after rolling and aging. FIG. 6 shows many dislocations around and/or within the second phase particles. These dislocations were formed during the tensile deformation and blocked by the second phase particles.

Without wishing to be bound by any particular explanation, it is believed that the second phase particles (which in the case for the aluminum alloy are the G-P zones and meta-stable η' phase) increase the resistance to dislocation movement by forcing dislocations to cut through, or circumvent, the fine precipitates, which increases the yield strength of the nanostructured sample. During tension, the second phase particles increase the dislocation density by blocking/trapping dislocations around and/or within particles. As a result, the second phase particles promote further dislocation storage during tensile deformation, thereby increasing the strain hardening and uniform tensile elongation and ductility of the nanostructured 7075 aluminum alloy sample.

It should be understood that while the invention has been generally described using an exemplary aluminum alloy, which is a preferred alloy, the invention is applicable to other alloys of aluminum, and more generally alloys (steel, for example) of any solid metal. Thus the invention is capable of providing nanostructured, high strength, ductile alloys of, for example, titanium, zirconium, hafnium, vanadium, niobium, tantalum, chromium, molybdenum, tungsten, iron, ruthenium, osmium, cobalt, rhodium, iridium, nickel, palladium platinum, copper, silver, gold, zinc, cadmium, and the like.

While cooling the workpiece using a liquid cryogen such as liquid nitrogen is preferable, it should be understood that other types of cooling may be used that include, but are not limited to cooling the workpiece using an ice bath, which also provides a cold workpiece but not as cold as one using a liquid cryogen. A cold workpiece may also be provided a dry ice/acetone or dry ice ethanol or liquid nitrogen/solvent cold baths. Similarly, cooling devices may be used to provide cold liquid such as cold methanol.

In summary, metal alloy was subjected to heating to provide the sample with a single-phase coarse-grain structure, and afterward the metal alloy was rolled at cryogenic temperature and thereafter subjected to aging to provide nanostructured grains with second phase particles in the grains. The second phase particles enhance both the strength and ductility of the nanostructured metal alloy.

The foregoing description of the invention has been presented for purposes of illustration and description and is not intended to be exhaustive or to limit the invention to the precise form disclosed, and obviously many modifications and variations are possible in light of the above teaching.

The embodiment(s) were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method for preparing a nanostructured aluminum alloy comprising:

heating an aluminum alloy workpiece at a temperature sufficient to produce a single phase of coarse-grained aluminum alloy;

refining the grain size of the workpiece by cooling the workpiece with liquid nitrogen to a workpiece temperature below −100° C. and then cold rolling the workpiece at a workpiece temperature below −100° C. until the average grain size is less than 200 nanometers and the strength of the workpiece increases; and thereafter aging the workpiece by heating it at a temperature in a range between about 50° C. to about 120° C. to induce the formation of second phase particles in the nanosized grains that increase the ductility without decreasing the strength of the workpiece.

2. The method of claim 1, wherein the ductility of the workpiece after aging is about twice what it is after refining the grain size but before aging.

3. The method of claim 1, wherein the step of refining the grain size comprises cold rolling the workpiece to about an 80 percent reduction in thickness.

4. A method for preparing a metal alloy comprising refining the grain size of a coarse-grained single phase metal alloy by cooling the coarse-grained single phase metal alloy with liquid nitrogen to a temperature below −100° C. and then cold rolling the metal alloy having a temperature of below −100° C. until the grains of the coarse-grained metal alloy are refined to an average grain size of less than 200 nanometers, the deformed metal alloy comprising a first strength S1 and a first ductility D1; and thereafter aging the metal alloy at a temperature from about 50° C. to about 120° C. to induce the formation of second phase particles in the grains of the alloy, the resulting aged alloy comprising an average grain size of approximately 100 nanometers and a second strength S2 and a second ductility D2, wherein S2≧S1; and wherein D2>D1.

5. The method of claim 4, wherein refining the grain size comprises cold rolling the alloy to about an 80 percent in reduction of thickness.

6. The method of claim 4,wherein S2>S1.

7. The method of claim 4 wherein the metal alloy comprises an aluminum alloy.

8. A method for producing a nanostructured metal alloy, comprising:

heating a metal alloy workpiece at a temperature sufficient to produce a single phase of coarse-grained metal alloy;

cold rolling the workpiece to about an 80% reduction in thickness at a workpiece temperature below −100° C. until the average grain size is less than 200 nanometers and the strength of the workpiece increases but the ductility decreases; and aging the workpiece by heating it at a temperature in a range between about 50° C. to about 120° C. to induce the formation of second phase particles in the nanosized grains that increase the ductility without decreasing the strength of the workpiece, wherein the average grain size of the workpiece decreases even further after aging but the ductility increases.

9. The method of claim 8, wherein the ductility of the workpiece increases after aging is about twice what it was after refining but before aging.

* * * * *